US009079449B2

(12) United States Patent
Gruber

(10) Patent No.: US 9,079,449 B2
(45) Date of Patent: Jul. 14, 2015

(54) DEVICE FOR STORING COLLECTIBLES

(76) Inventor: Hermann Gruber, Munich (DE)

( * ) Notice: Subject to any disclaimer, the term of this patent is extended or adjusted under 35 U.S.C. 154(b) by 154 days.

(21) Appl. No.: 13/389,639

(22) PCT Filed: Aug. 9, 2010

(86) PCT No.: PCT/EP2010/061541
§ 371 (c)(1),
(2), (4) Date: Feb. 9, 2012

(87) PCT Pub. No.: WO2011/018429
PCT Pub. Date: Feb. 17, 2011

(65) Prior Publication Data
US 2012/0138492 A1 Jun. 7, 2012

(30) Foreign Application Priority Data
Aug. 13, 2009 (DE) ..... 20 2009 010 975 U

(51) Int. Cl.
*B65D 21/032* (2006.01)
*B42F 7/14* (2006.01)

(52) U.S. Cl.
CPC ..... *B42F 7/14* (2013.01)

(58) Field of Classification Search
CPC ..... B42F 7/14; B65D 21/00; B65D 21/0209
USPC ..... 206/232, 216, 514; 220/23.83, 23.88, 220/503, 504, 23.87, 23.89, 23.4
See application file for complete search history.

(56) References Cited

U.S. PATENT DOCUMENTS

| | | | | |
|---|---|---|---|---|
| 3,708,061 | A * | 1/1973 | Weingarden et al. | 206/391 |
| 4,807,760 | A * | 2/1989 | Sussman | 206/581 |
| 5,637,364 | A * | 6/1997 | Akao et al. | 428/34.2 |
| 5,823,347 | A * | 10/1998 | Mattes | 206/555 |
| 5,909,897 | A | 6/1999 | Lu | |
| 8,006,860 | B2 * | 8/2011 | Klein | 220/503 |
| 2012/0292327 | A1 * | 11/2012 | Carey | 220/592.2 |

FOREIGN PATENT DOCUMENTS

| | | |
|---|---|---|
| EP | 0 301 163 | 2/1989 |
| FR | 2 693 952 | 7/1992 |
| GB | 2 232 639 | 12/1990 |
| GB | 2 422 352 | 7/2006 |
| JP | 2001199183 | 7/2001 |

* cited by examiner

*Primary Examiner* — Steven A. Reynolds
(74) *Attorney, Agent, or Firm* — Reising Ethington P.C.

(57) ABSTRACT

A device for storing collectibles, including a base unit having a first receiving region that receives a first object and a second receiving region that receives a collectibles storage unit. The base unit has a connecting wall connecting the first and second side walls, and two receiving elements for mounting the storage unit. The first receiving region is delimited by the first side wall, the second side wall and the connecting wall. The second receiving region, open on at least one side and separated from the first receiving region by the connecting wall, is delimited by the first receiving element, the second receiving element and the connecting wall. The storage unit includes at least two segments connectable to and separable from each other, wherein each segment has a receiving region for receiving at least one collectible and wherein at least a partial region of each segment is transparent.

5 Claims, 11 Drawing Sheets

DEVICE FOR STORING COLLECTIBLES

The invention relates to a device for storing collectibles, comprising a base unit having a first receiving region for receiving a first object and a second receiving region for receiving a storage unit for the collectibles. The base unit comprises a first and a second side wall, a connecting wall connecting the side walls to each other and a first and a second receiving element, each fixedly connected to the connecting wall and/or to one of the side walls. The first receiving region is delimited by the first and the second side wall as well as by the connecting wall, whereas the second receiving region is delimited by the first and the second receiving element as well as by the connecting wall and is open on at least one side. The storage unit is attachable to the base unit by means of the first receiving element and/or the second receiving element.

Hitherto, the back of books and the back of book-like objects, in particular of cartridges and slipcases, merely served to indicate the title and/or the author of the book or to describe the contents contained in the cartridge, respectively. However, this is disadvantageous in so far as, on the one hand, the outward appearance, being almost exclusively defined by the back, of a book or book-like object standing in a rack is unalterable. On the other hand, it is disadvantageous that there is no way of individualizing the book or the book-like object, in particular of individualizing the optical appearance of the back of the book.

From Document U.S. Pat. No. 5,909,897, a photo album for storing pictures and films is known. The back of the photo album comprises a shaft, into which a receiving unit for receiving a plurality of films can be inserted. Further, the photo album comprises a cover, by means of which the receiving unit inserted into the shaft of the back can be covered thus that it is no longer visible and that only the cover is visible as book back. By means of the cover unit, the films inserted into the receiving unit are no longer visible. Thus, the receiving unit is not suitable for receiving collectibles individualizing the back of the book and does not offer the option of individualizing the optical appearance of the back, either. Further it is disadvantageous that individual receiving regions of the receiving unit for receiving the films are inseparably connected to each other so that the receiving regions including the films received therein cannot be interchanged between different receiving units. In particular, it is therefore not possible to take along only a receiving region of the receiving unit, e.g. on a journey, but invariably, the entire receiving unit has to be taken along. Furthermore, it is disadvantageous that the mounting of the receiving unit in a shaft of the back is complex, which makes handling more difficult.

The object of the invention is to provide a device for storing collectibles, in which the optical appearance of the device can be individually shaped by means of the collectibles and in which the receiving units receiving the collectibles can be easily interchanged and combined with each other.

This object is solved by a device according to the features of claim 1. Advantageous embodiments of the invention are outlined in the dependent claims.

As a consequence of the storage unit being constructed thus that it consists of at least two segments connectible to and separable from each other, each having a receiving region for receiving at least one collectible, the segments with the collectibles contained therein, can be connected to each other in any desired order. Further, the segments of different storage units can be interchanged as desired, so that at large there is a great variety of shaping options for individualizing the base unit. As a consequence of the segments being separable, it is in particular achieved that, for example on a journey, not the entire storage unit but only the segments actually required for insertion of the collectibles have to be taken along. As a consequence of the at least one partial region of each segment being transparent, the aim is achieved that the collectibles contained in the segments are visible to the beholder, so that said collectibles play a decisive role in determining the individual outward appearance.

The segments of the storage unit are preferably connectible to each other by means of a threaded connection, a latching connection, a clipped connection and/or a magnetic connection. Thus, the aim is achieved that the segments are easily connectible to and separable from each other.

Preferably, the entire storage unit is transparent. Thus, the aim is achieved that, when introducing the storage unit into the second receiving region of the base unit, it must not be made sure that the transparent partial region of each segment faces away from the connecting wall in order to render the collectibles contained in the segments visible to the beholder. To this end, the segments are in particular made of plexiglass. Such segments made of plexiglass are stable and do not break even when being dropped. In an alternative embodiment of the invention, the segments may also be made of glass.

In a preferred embodiment of the invention, each of the segments comprises a bottom and a cylindrical wall fixedly connected to the bottom. The receiving region of each segment is delimited by the wall and the bottom. Each segment has an opening on the opposite side of the bottom, through which the collectibles can be introduced into the respective receiving region. The opening of a first segment is locked by the bottom of a second segment when the first segment and the second segment are connected to each other. As a consequence, the aim is achieved that the first segment has a closed receiving region to prevent the collectibles from falling out. Therefore, in particular loose material, such as sand for example, may also be contained. As the lid of the first segment is constituted by the bottom of the second segment, a separate lid for the first segment can be dispensed with, so that the construction of the storage unit is simplified. The opening of the upper segment of the storage unit is locked in particular by means of a lid.

Preferably, the storage unit is attachable to the base unit by a clipped connection formed by the first receiving element and the second receiving element. To this end, the interval between the first and the second receiving element is in particular smaller than the height of the storage unit. By means of such clipped connection, attaching the storage unit to the base unit is simplified. The storage unit can be separated from the base unit without a locking mechanism connecting the storage unit to the base unit having to be disconnected beforehand. In particular, consequently the storage unit can be detached from the base unit when the base unit stands in a rack.

Further, it is advantageous if the second receiving element is arranged in parallel to the first receiving element and if a third receiving element and a fourth receiving element are provided, wherein the fourth receiving element extends in parallel to the third receiving element. The third and fourth receiving elements are each fixedly connected to the connecting wall and/or to one of the side walls. The receiving region is delimited by the four receiving elements and the connecting wall. Thus, the aim is achieved that the second receiving region is delimited towards five sides so that a storage unit contained in the second receiving region is protected by the receiving elements. Moreover, this results in a secure attachment of the storage unit to the base unit.

Furthermore, advantageously the first, the second, the third and/or the fourth receiving elements are shaped in a plate-like form. It is particularly advantageous if the first, the second, the third and the fourth receiving elements as well as the connecting wall constitute an open case for reception of the storage unit. As a result, a storage unit contained in the case is well protected, on the one hand, and well visible, on the other hand. This open case in particular constitutes kind of a showcase.

In a preferred embodiment of the invention, the first side wall is a first cover of a book and the second side wall is a second cover of a book. In this case the object preferably comprises the bound pages of a book so that the base unit and the first object contiguously form a book. The book back is constituted by the storage unit, so that the book back can be individually and variably shaped by individually shaping the storage unit by the introduction of collectibles. In particular, souvenirs related to events associated with the book may be introduced into the storage unit.

Advantageously, the first side wall and the second side wall respectively are connected to the connecting wall by means of a film hinge. Consequently the first and the second side walls can respectively be opened as done with conventional books.

In an alternative embodiment of the invention, the connecting wall constitutes a first connecting wall. Further, a second and a third connecting wall is provided, the third connecting wall being arranged in parallel to the second connecting wall. The first and the second side walls are respectively connected to each other via the second and the third connecting wall. Further, the second connecting wall and the third connecting wall respectively are arranged orthogonally in respect to the first side wall, the second side wall and the connecting wall. Consequently, the first receiving region is delimited by five walls, so that the receiving region is open on only one side. The walls are in particular constituted thus that, through the opening, a book can be introduced into the receiving region. As a result, the base unit constitutes a slipcase for receiving books and/or book-like objects. By means of the storage unit, the back of the slipcase can be individually shaped.

In a further alternative embodiment of the invention, the base unit may constitute a cartridge for receiving the first object. In addition to the cartridge, the storage unit offers further storage room facilitating in particular an individual shaping of the cartridge back with souvenirs related to the objects contained in the cartridge.

Advantageously, the storage unit comprises a magnet and/or a metallic object and the first, the second, the third and/or the fourth receiving element comprises a magnet for mounting the storage unit via a magnetic connection. Thus, the storage unit can be securely mounted to the base unit without positive locking being required.

In an alternative embodiment of the invention, the base unit constitutes a first base unit connected to a second base unit having a third receiving region for receiving a second object. The second base unit comprises a first and a second side wall as well as a first connecting wall connecting the side walls to each other. Herein, the third receiving region is delimited by the first side wall, the second side wall and the connecting wall of the second base unit. The connecting wall of the first base unit constitutes a first connecting wall of the first base unit. Further, both the first base unit and the second base unit each comprise a second connecting wall and a third connecting wall, the third connecting wall being arranged in parallel to the second connecting wall, wherein the first and the second side walls respectively are connected to each other by the second and the third connecting wall and wherein the second and the third connecting walls respectively preferably are arranged orthogonally in respect to the first side wall, the second side wall and the first connecting wall. The first side wall of the first base unit is connected to the first side wall of the second base unit by means of a hinge. The first base unit and the second base unit being connected to each other by means of the hinge, the two base units are pivotable relative to each other.

The first base unit and the second base unit each form a slipcase for receiving books or book-like objects. In a first position, the first side wall of the first base unit and the first side wall of the second base unit are arranged such that the sides of the first side walls facing away from the first and the third receiving region, respectively, face each other, in particular contact each other. In this position, books and/or book-like objects can be introduced into the first and the third receiving region. The first position in particular is such position, in which the device can be positioned in a rack. In a second position, the first side wall of the first base unit and the first side wall of the second base unit are arranged on one level. In this second position, the openings of the first and the second base unit, through which the books or book-like objects are receivable, are closed due to the base units being thus pivoted about the hinge that they mutually lock the openings.

In a preferred embodiment of the invention, the second base unit comprises a first receiving element fixedly connected to the first connecting wall of the second base unit and/or connected to one of the side walls of the second base unit and a second receiving element also connected to the first connecting wall of the second base unit and/or to one of the side walls of the second base unit. By the first receiving element, the second receiving element and the first connecting wall of the second base unit, a fourth receiving region for receiving a further storage unit separated from the third receiving region by the first connecting wall, open on at least one side, is delimited. The further storage unit comprises at least two segments that can be connected to and separated from each other, wherein each segment has a receiving region for receiving at least one collectible. The storage unit and the further storage unit are in particular identically formed. By providing two storage units the back of each base unit can be individually shaped. As a consequence of the multi-part, segmented construction of the storage unit, the segments can be interchanged between the two storage units in any desired way. This increases the number of possible combinations and individual shaping options.

Advantageously, the first side wall of the first base unit and the first side wall of the second base unit are made of one piece and the hinge is a film hinge. This leads to a simpler manufacture and an increased stability of the device.

The second base unit is subject to the same embodiments as those applying to the first base unit. In particular, the second base unit may be further developed to have the features cited in dependent claims 2 to 14. Particularly advantageously, the first base unit and the second base unit are identically formed. This results in a consistent appearance of the device under both conditions, folded up and folded apart.

Moreover, advantageously the device comprises drilling holes by means of which it can be hung up on a wall or the like. To this end, the device comprises at least one drilling hole in particular in each of the first side walls, so that the device can be hung up on a wall by using nails. In an alternative embodiment of the invention, the drilling holes can also be provided in the second side walls.

In a preferred embodiment of the invention, the first side wall of the first base unit, the first side wall of the second base unit, the second side wall of the first base unit and/or the second side wall of the second base unit respectively comprises a slide-in compartment for receiving a leaf-shaped medium, wherein the slide-in compartment, on the side facing away from the first receiving region, respectively from the third receiving region, is delimited by transparent delimiting means. The transparent delimiting means are in particular a panel of glass or plexiglass. As a consequence, the aim is achieved that the leaf-shaped medium contained in the slide-in compartment is visible to the beholder. The leaf-shaped medium in particular is a picture that preferably topically relates to the objects contained in the first base unit and the second base unit. Particularly advantageously, the second side wall of the first base unit and the second base unit respectively comprise a slide-in compartment, so that the pictures contained in the slide-in compartments are visible when the device is hung-up on a wall via its first side walls. By providing such slide-in compartments, the individual shaping options of the device are further increased. Moreover, the slide-in compartments facilitate easy and quick replacement of the pictures or leaf-shaped media, so that the optical outward appearance of the device may easily be adapted to the first and second objects contained in the first and third receiving regions.

Further features and advantages of the invention will become apparent from the following description which outlines the invention by means of embodiments with reference to the accompanying drawings.

The drawings comprise:

Figure 1:
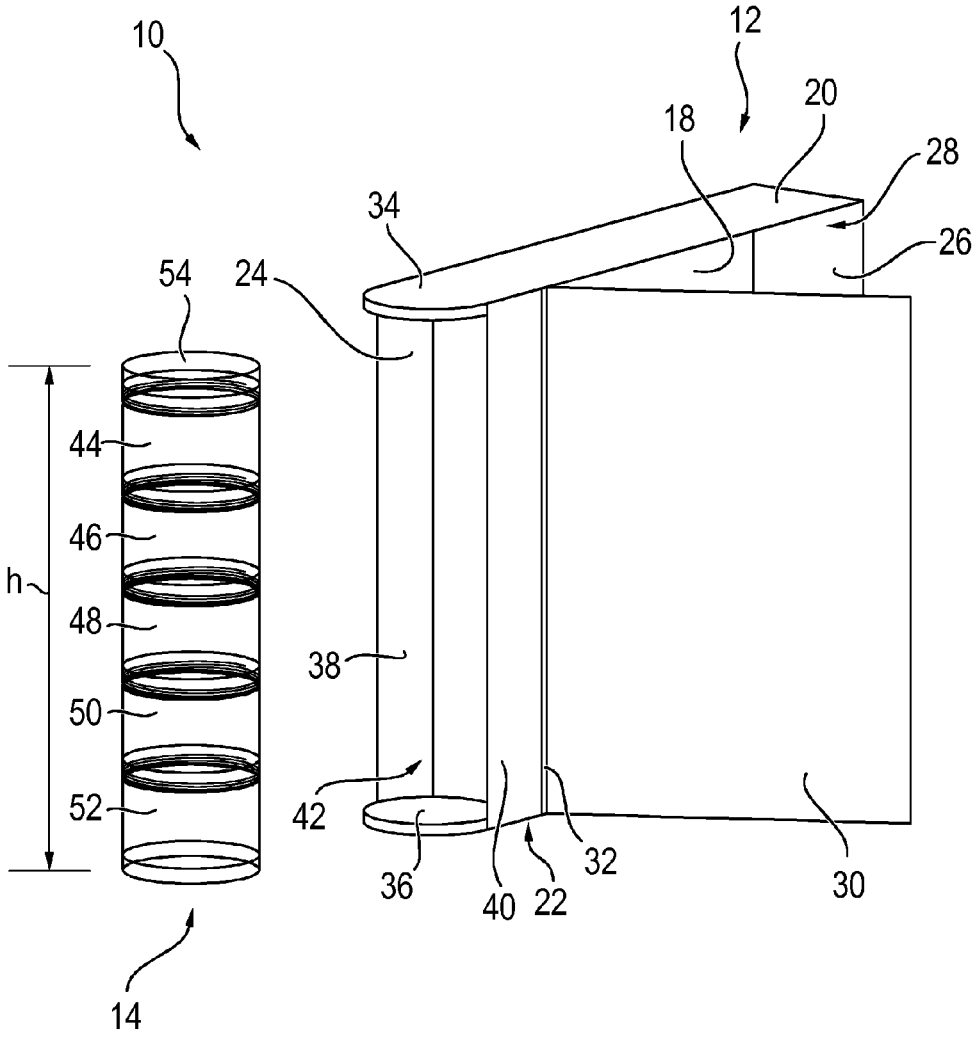
FIG. 1 is a schematic perspective view of a device for storing collectibles, wherein the storage unit has been detached according to a first embodiment of the invention.

FIG. 1 is a schematic perspective view of a device 10 for storing collectibles, one of which by way of example is referred to by reference numeral 16, according to a first embodiment of the invention. The device 10 comprises a base unit 12 in the form of a cartridge and a storage unit 14 for storing the collectibles 16.

The cartridge 12 comprises a first side wall 18 and a total of four connecting walls 20 to 26 fixedly connected to the first side wall 18. The first side wall 18 and the four connecting walls 22 to 26 delimit a first receiving region 28 of the cartridge 12 for storing a first object. The first objects contained in the cartridge 12 may for example be books, cards, newspaper clippings, letters, photographs, finds and/or postcards. Further, the cartridge 12 comprises a second side wall 30 connected to the first connecting wall 24 by means of a film hinge 32 and forming a lid for closing the opening of the first receiving region 28 of the cartridge 12.

Further, the cartridge 12 comprises four receiving elements 34 to 40 delimiting, together with the first connecting wall 24, a second receiving region 42 of the cartridge 12 for introduction of the storage unit 14. The first connecting wall 24 separates the second receiving region 42 from the first receiving region 28 of the cartridge 12. The interval between the first receiving element 34 and the second receiving element 36 is smaller than the height h of the storage unit 14, so that by the first and the second receiving elements 34, 36 a clipped connection is constituted for mounting the storage unit 14 to the cartridge 12. As a consequence, the storage unit 14 may easily and quickly be inserted into the second receiving region 42 of the cartridge 12 and will automatically be secured to the cartridge 12 thus that the storage unit 14 is prevented from accidentally falling out of the second receiving region 42. This also facilitates quick removal of the storage unit 14 out of the second receiving region 42 of the cartridge 12 without having to disconnect mounting means to this end.

Figure 2:
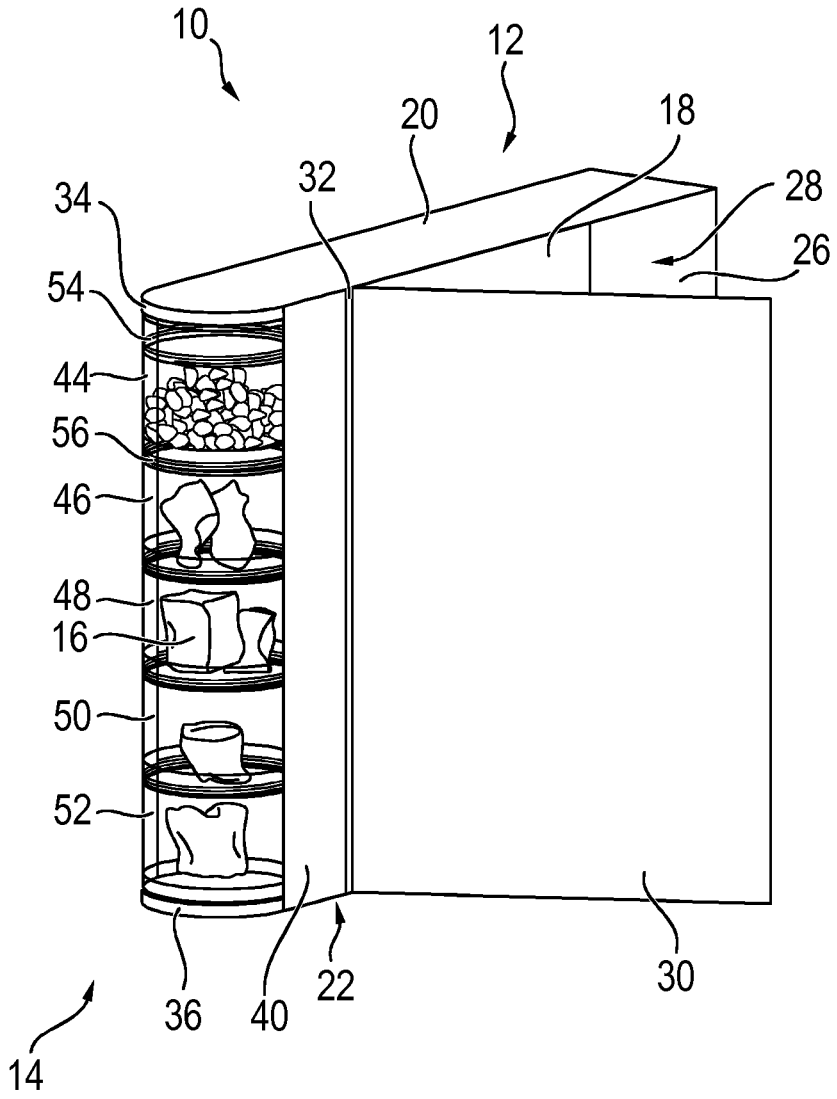
FIG. 2 is a schematic perspective view of the device according to FIG. 1, wherein the storage unit is inserted.

FIG. 2 is a schematic perspective view of the device 10 according to FIG. 1 showing the storage unit 14 being contained within the second receiving region 42 of the cartridge 12. Elements having the same structure or functionality are provided with the same reference numeral.

In an alternative embodiment of the invention, the clipped connection for mounting the storage unit 14 may in addition to or as an alternative for the first and second receiving elements 34, 36 also be constituted by the third and the fourth receiving elements 38, 40. This leads to a secure mounting of the storage unit 14 in the second receiving region 42. In particular, the third and the fourth receiving elements 38, 40 prevent the storage unit 14 from laterally slipping out of the second receiving region 42. In a further alternative embodiment of the invention, the cartridge 12 merely comprises two receiving elements 34, 36, so that the storage unit 14 contained in the second receiving region 42 is visible from three sides. In this case, the storage unit 14 is mounted to the cartridge 12 exclusively via the clipped connection constituted by the first and the second receiving element 34, 36.

The storage unit 14 is formed to have a plurality of parts thus comprising five segments 44 to 52 and a lid 54. Two adjacent segments 44 to 52 can respectively be connected to each other and separated from each other by a threaded connection. One of these threaded connections by way of example is referred to by reference numeral 56. The segments 44 to 52 may also be connected to each other via a latching connection, a clipped and/or a magnetic connection. The threaded connection 56 of segments 44 to 52 results in a simple and secure connection of the segments 44 to 52 to each other. Further, the segments 44 to 52 may easily be separated from each other and put together again at any time and in any desired order. In an alternative embodiment, the storage unit 14 may also comprise more or less than five segments 44 to 52.

Figure 3:
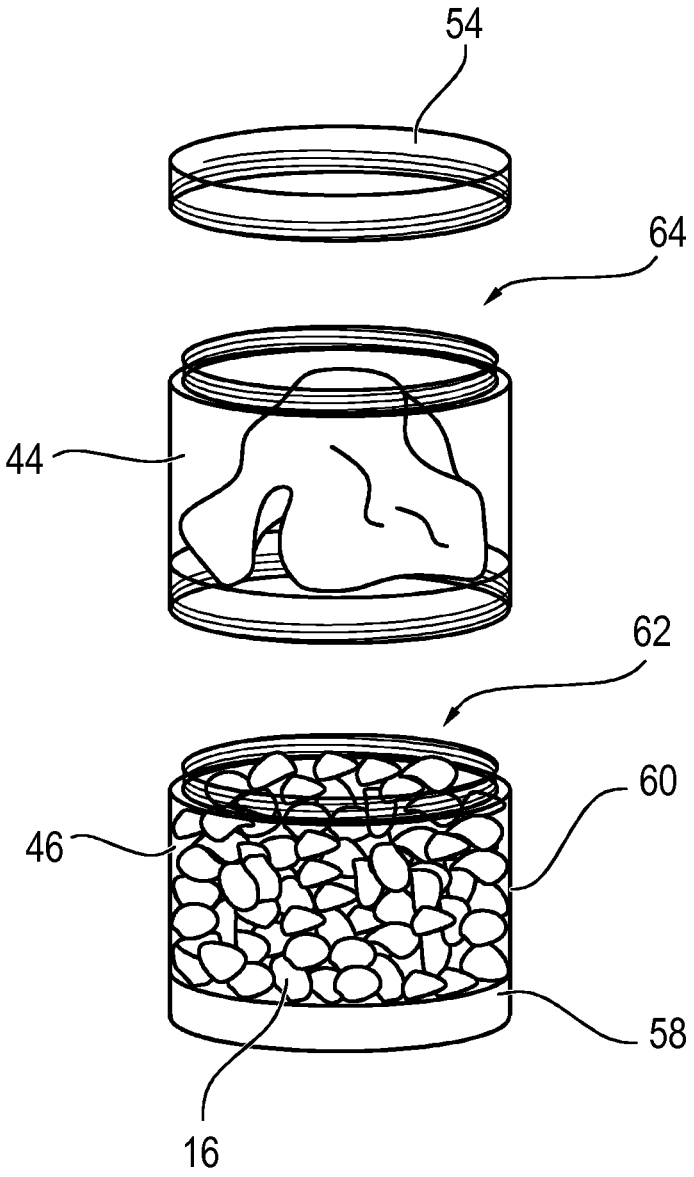
FIG. 3 is a schematic perspective view of two segments and a lid of the storage unit according to FIGS. 1 and 2.

FIG. 3 is a schematic perspective view of two segments 44, 46 and the lid 54 of the storage unit 14 according to FIGS. 1 and 2. Here, the segments 44, 46 and the lid 54 are shown in a non-connected state.

The segments 44 to 52 each comprise a bottom 58 and a cylindrical wall 60 fixedly connected to the bottom 58. The bottom 58 and the wall 60 form a receiving region for receiving collectibles 16, wherein each segment 44 to 52 may at least receive one collectible 16. The segments 44 to 52 each comprise an opening 62 provided on the side opposite the bottom 58, through which the collectibles 16 can be introduced into the respective segment 44 to 52. The segments 44 to 52 are formed thus that in the connected state, a first segment 44 locks the opening 62 of a second segment 46, so that the receiving region of the second segment 46 is locked, which prevents the collectibles 16 contained in the receiving region of the second segment 46 from falling out. Consequently, the aim is achieved that the opening of any of segments 44 to 52 is always locked by the segment 44 to 52 disposed above. The opening 64 of the upper segment 44 is locked by means of the lid 54, so that also the collectibles 16 contained in the receiving region of the upper segment 44 are prevented from falling out of segment 44.

As a consequence of the storage unit 14 having a multi-part form and comprising a plurality of segments 44 to 52, the segments 44 to 52 of a plurality of storage units 14 can be interchanged in any desired way. Also the order of segments 44 to 52 with the collectibles 16 contained therein, may be changed within the storage unit 14. Thus, the appearance of the storage unit 14 may be varied in any desired way. A further advantage of the multi-part form of the storage unit 14 is that, for example on a journey, only the number of segments 44 to 52 to be actually filled, has to be taken along. It is not necessary to take along the entire storage unit 14.

The segments 44 to 52 and the lid 54 are made of a transparent material, so that the collectibles 16 contained are visible to the beholder. To this end, the segments 44 to 52 and the lid 54 are in particular made of plexiglass or glass.

The storage unit 14 forms the back of the cartridge 12. By filling of the collectibles 16 into the segments 44 to 52, the back of the cartridge 12 can be individually shaped. The collectibles 16 contained in the segments 44 to 52 of the storage unit 14 in particular are objects topically related to the objects contained in the first receiving region 28 of the cartridge 12. The collectibles 16 may for example be spicery, sand, stones, mussels, paper sheets, teeth and/or hair.

The multi-part form of the storage unit 14 further increases the number of possible individual shaping options of the back of the cartridge 12 as the segments 44 to 52 may be interchanged and their order altered in any desired way without the collectibles 16 having to be removed from the segments 44 to 52. This prevents the collectibles 16 from getting lost or being damaged.

Figure 4:
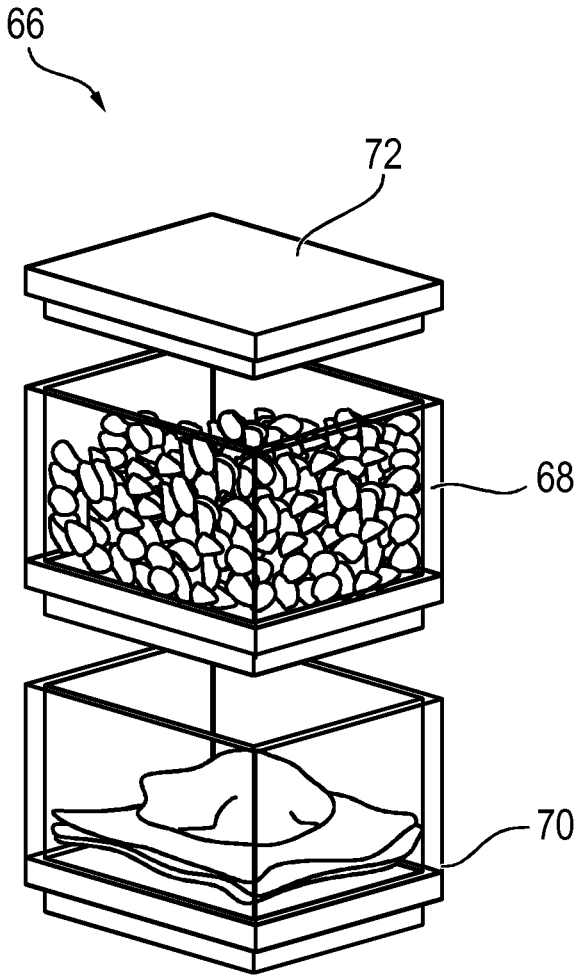
FIG. 4 is a schematic perspective view of a storage unit according to a further embodiment of the invention.

FIG. 4 is a schematic perspective view of a storage unit 66 according to a second embodiment. The storage unit 66 comprises two segments 68, 70 and a lid 72. In contrast to the first embodiment according to FIGS. 1 to 3, the segments 68, 70 and the lid 72 do not have a cylindrical but a rectangular form. The segments 68, 70 are connected to each other via a plug-in connection. In the same way, the lid 72 is fitted to the opening of segment 68.

The storage unit 66 having this cuboid form, the second receiving region 42 of the cartridge 12 is correspondingly formed complementary to the storage unit 66 in such a way that it is form-fittingly receivable in the second receiving region 42.

In an alternative embodiment of the invention, the base unit 12 may not be formed as a cartridge but constitutes a slipcase or a book. This leads to an individually shaped appearance of the back of the slipcase or the book, respectively by individually shaping the storage unit 14, 66, in particular by means of the collectibles 16 contained in the segments 44 to 52, 68, 70.

Figure 5:
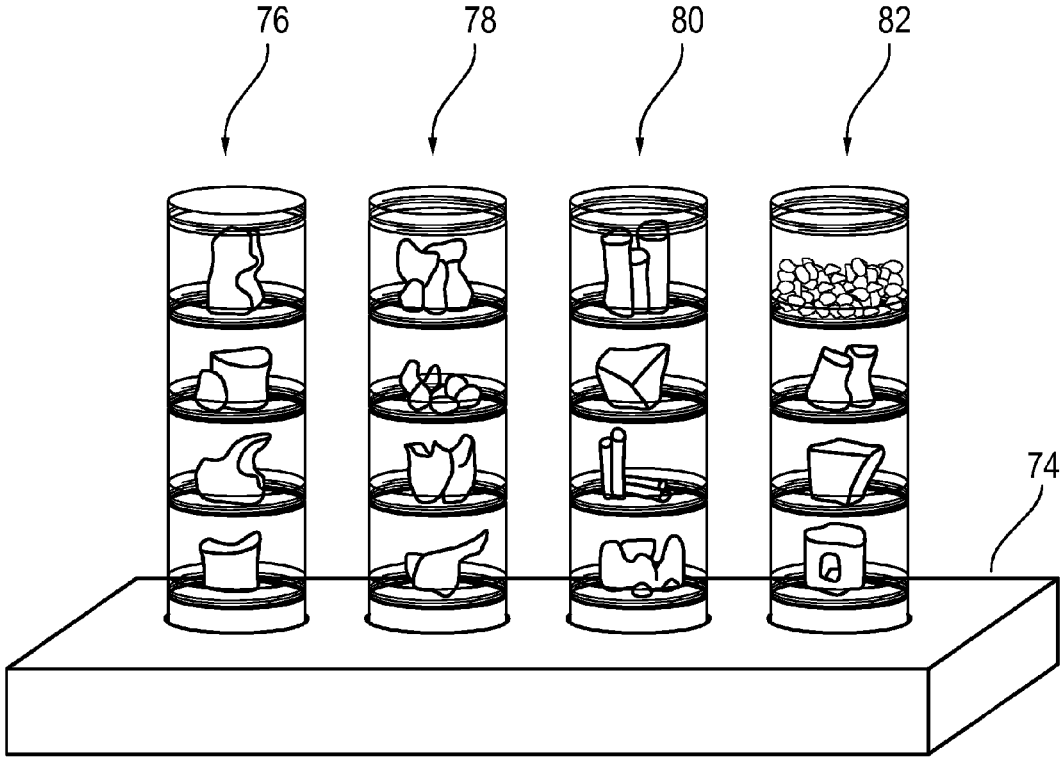
FIG. 5 is a schematic perspective view of a mount for positioning storage units with collectibles contained therein.

FIG. 5 is a schematic perspective view of a mount 74 for positioning storage units 76 to 82. To this end, the mount 74 comprises four recesses, into each of which a storage unit 76 to 82 has been inserted. Owing to such mount 74, the storage units 76 to 82 may be positioned, for example in a rack, independently from the base unit 12 to be viewed by a person.

Figure 6:
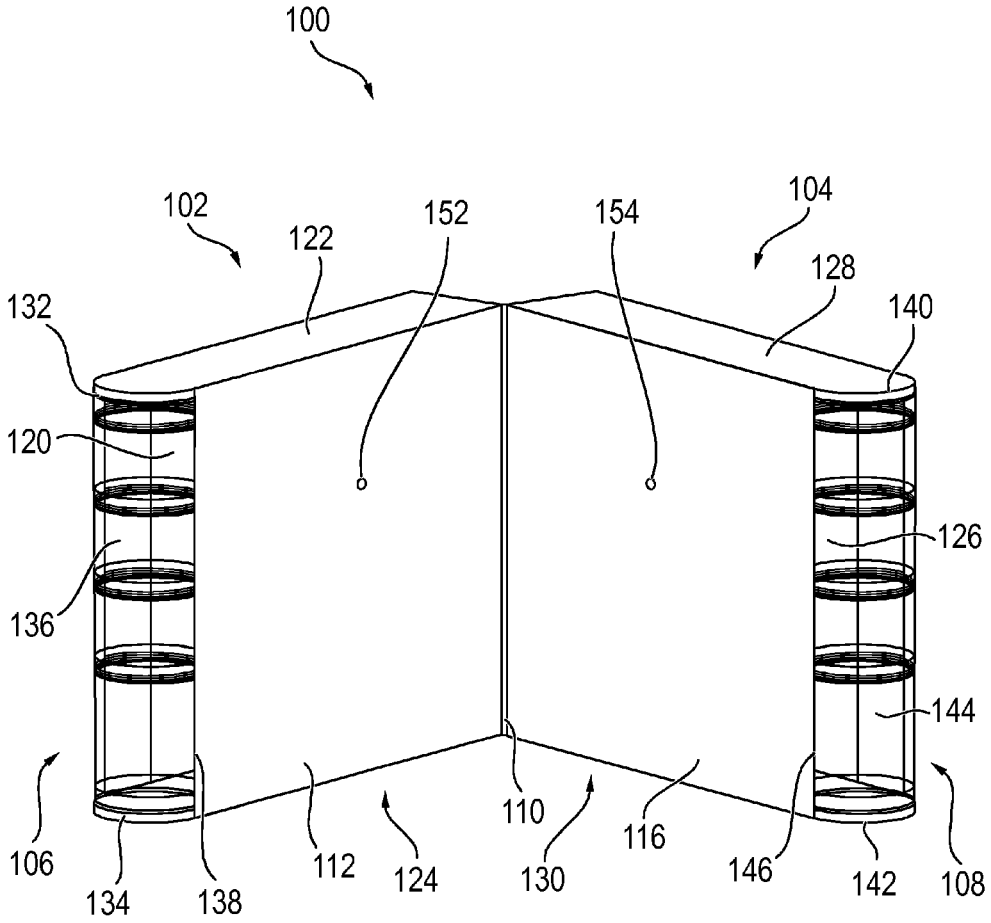
FIG. 6 is a schematic perspective view of a device for storing collectibles according to a second embodiment of the invention.

FIG. 6 is a schematic perspective view of a device 100 for storing collectibles 16 according to a second embodiment of the invention. The device 100 comprises two base units 102, 104 in the form of a slipcase pivotably connected to each other via a film hinge 110. Further, the device 100 comprises two storage units 106, 108 for storing the collectibles 16. Each of the storage units 106, 108 has a multi-part form and comprises a plurality of segments for receiving the collectibles 16 connectible to each other via threaded connections. The storage units 106, 108 are in particular identical with the storage unit 14 according the first embodiment of the invention.

The slipcases 102, 104 respectively comprise two side walls 112 to 118 as well as three connecting walls 120 to 130 connecting the respective side walls 112 to 118 to each other. The two side walls 112 to 118 and the three connecting walls 120 to 130 respectively delimit a first receiving region for receiving a book-like object. Each receiving region has an opening, through which the book-like object is introduced into the receiving region. The side walls 112 to 118 are in particular respectively arranged orthogonally in respect to the connecting walls 120 to 130.

Further, each of the slipcases 102, 104 comprises four receiving elements 132 to 146 for mounting the storage unit 106, 108 to the slipcases 102, 104. Preferably, the receiving element 132 and the connecting wall 122, the receiving element 134 and the connecting wall 124, the receiving element 136 and the side wall 114, the receiving element 138 and the side wall 112, the receiving element 140 and the connecting wall 128, the receiving element 142 and the connecting wall 130, the receiving element 144 and the side wall 118 and the receiving element 146 and the side wall 116 are formed in one piece, respectively.

Figure 7:
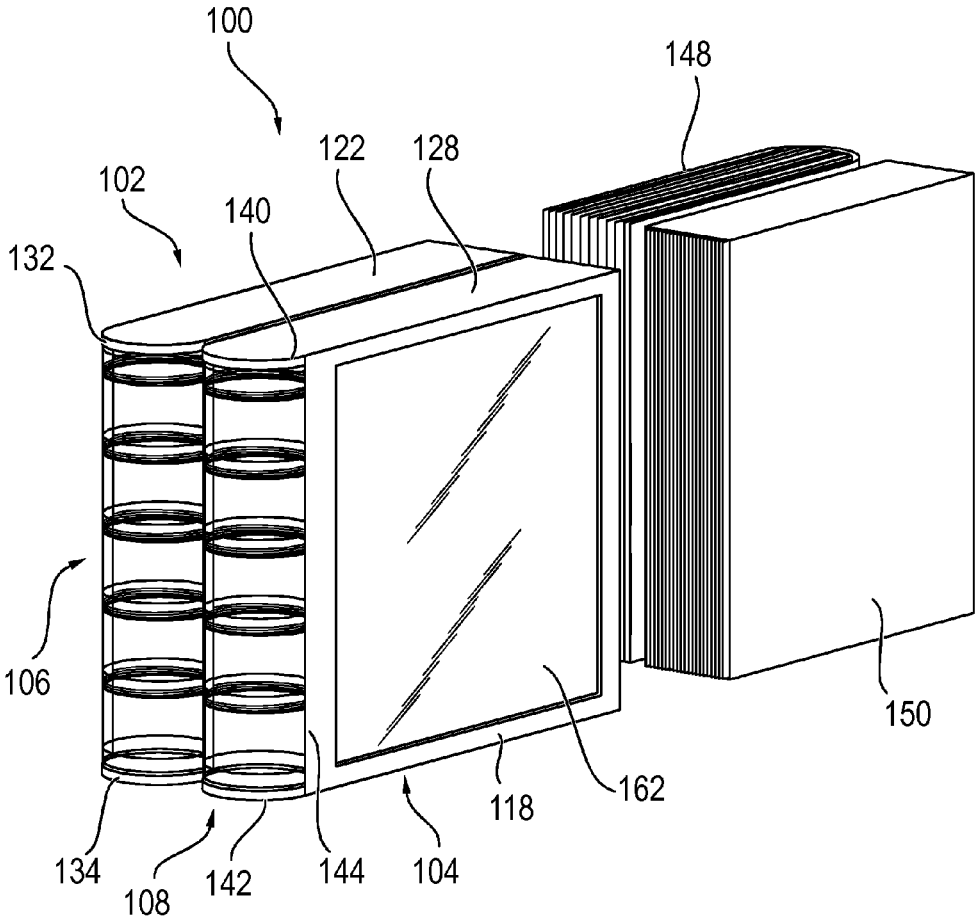
FIG. 7 is a schematic perspective view of the device according to FIG. 6 in a folded-up condition and of two book-like objects receivable in the device.

FIG. 7 is a schematic perspective view of the device 100 according to FIG. 6 in a folded-up condition. In the folded-up condition, the slipcases 102, 104 are pivoted about the axis formed by the film hinge 110 to such an extent that the first side wall 112 of the first slipcase 102 and the first side wall 116 of the second slipcase 104 are arranged facing each other in a parallel position to one another. In this folded-up condition, the side walls 112 and 116 contact each other. The folded-up condition is such condition, in which the device 100 is received in a rack. In this folded-up condition, the storage units 106, 108 are turned towards a beholder of the rack, so that the storage unit 106, 108 constitutes the back of the device 100. In the folded-up condition, the openings of the receiving regions of the slipcases 102, 104 are open for insertion of the book-like objects 148, 150 into the receiving regions of the slipcases 102, 104.

Figure 8:
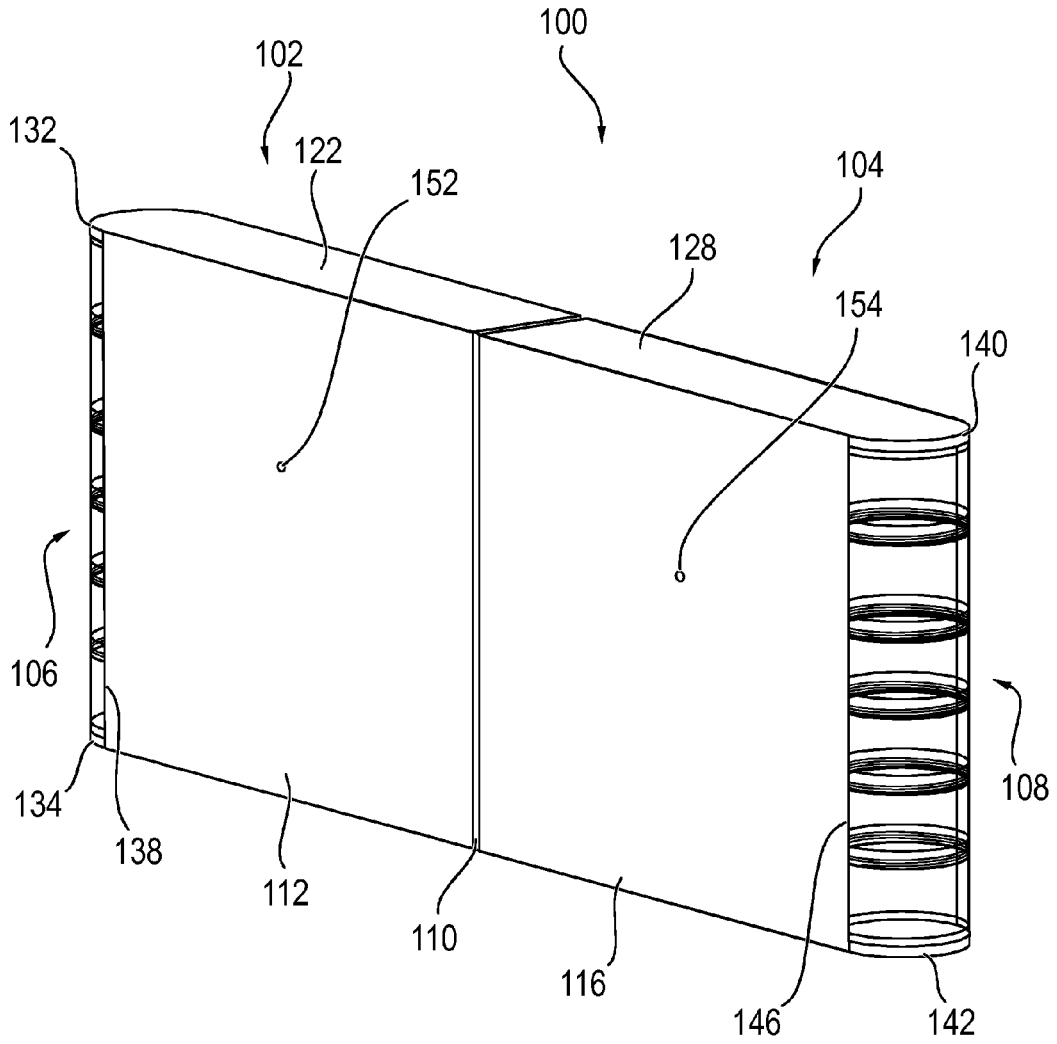
FIG. 8 is a schematic perspective view of the device according to FIGS. 6 and 7 in a folded-apart condition.

FIG. 8 is a schematic perspective view of the device 100 according to FIGS. 6 and 7 in a folded-apart condition. In the folded-apart condition, the slipcases 102, 104 are pivoted about the axis formed by the film hinge 110 to such an extent that the first side wall 112 of the first slipcase 102 and the first side wall 116 of the second slipcase 104 are arranged on one level. The slipcases 102 to 104 in this case are positioned such that they mutually lock their respective receiving regions.

The first side wall 112 of the first slipcase 102 and the first side wall 116 of the second slipcase 104 each have a recess 152, 154 for facilitating their attachment to a wall or the like for example by means of nails. Alternatively, in the folded-apart condition, the device 100 can also be positioned on a surface. In an alternative embodiment of the invention, more than two recesses 152, 154 may be provided for attaching the device 100 to a wall.

Figure 9:
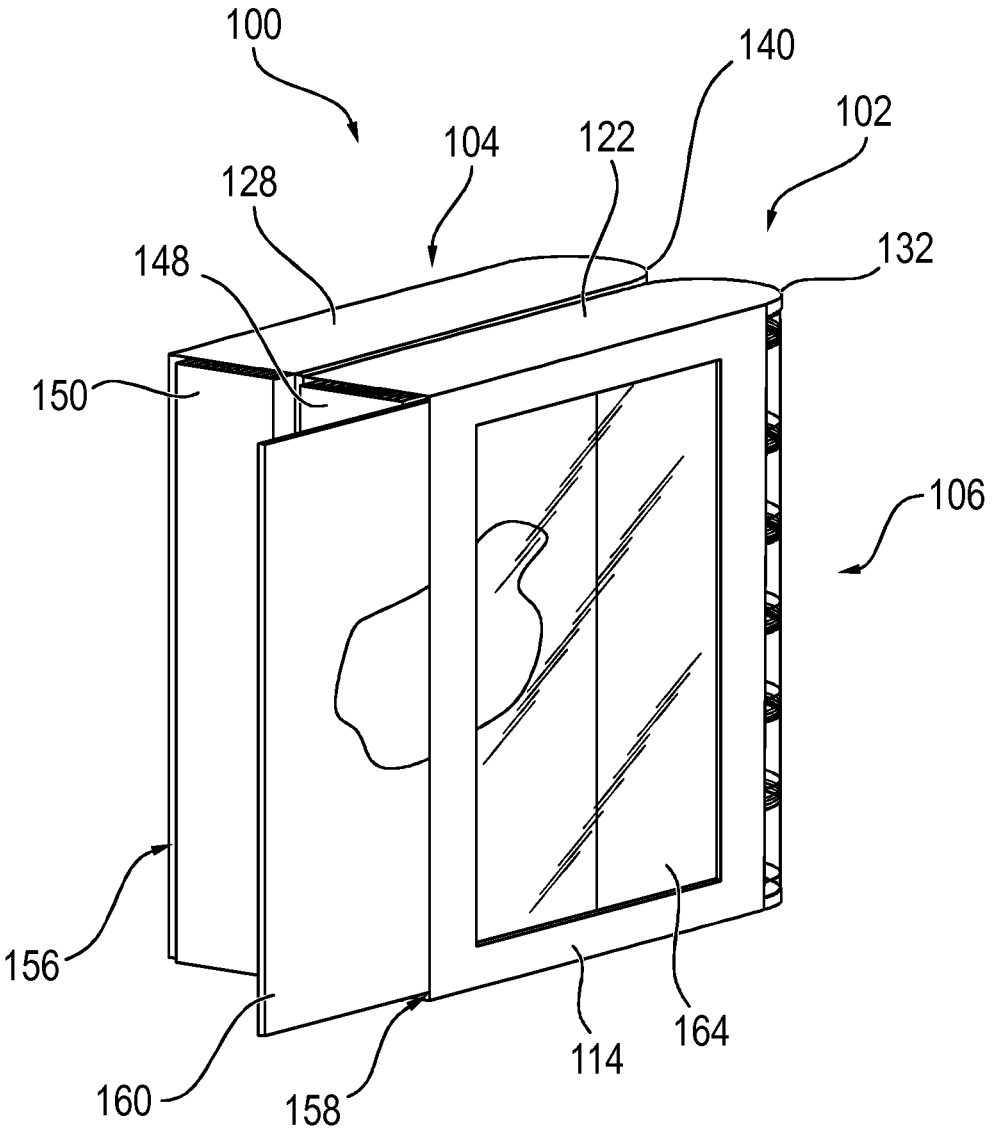
FIG. 9 is a schematic perspective view of the device according to FIGS. 6 to 8 in a folded-up condition during the introduction of a picture into a slide-in compartment.

FIG. 9 is a further schematic perspective view of the device 100 according to FIGS. 6 to 8 in the folded-up condition. Both the second side wall 114 of the first slipcase 102 and the second side wall 118 of the second slipcase 104 are each provided with a slide-in compartment 156, 158 for receiving a picture 160. The second side walls 114, 118 each have a window face 162, 164 through which at least a respective part of the picture 160 contained in the respective slide-in compartment 156, 158 is visible. The window faces 162, 164 are in particular constituted by a glass panel.

Figure 10:
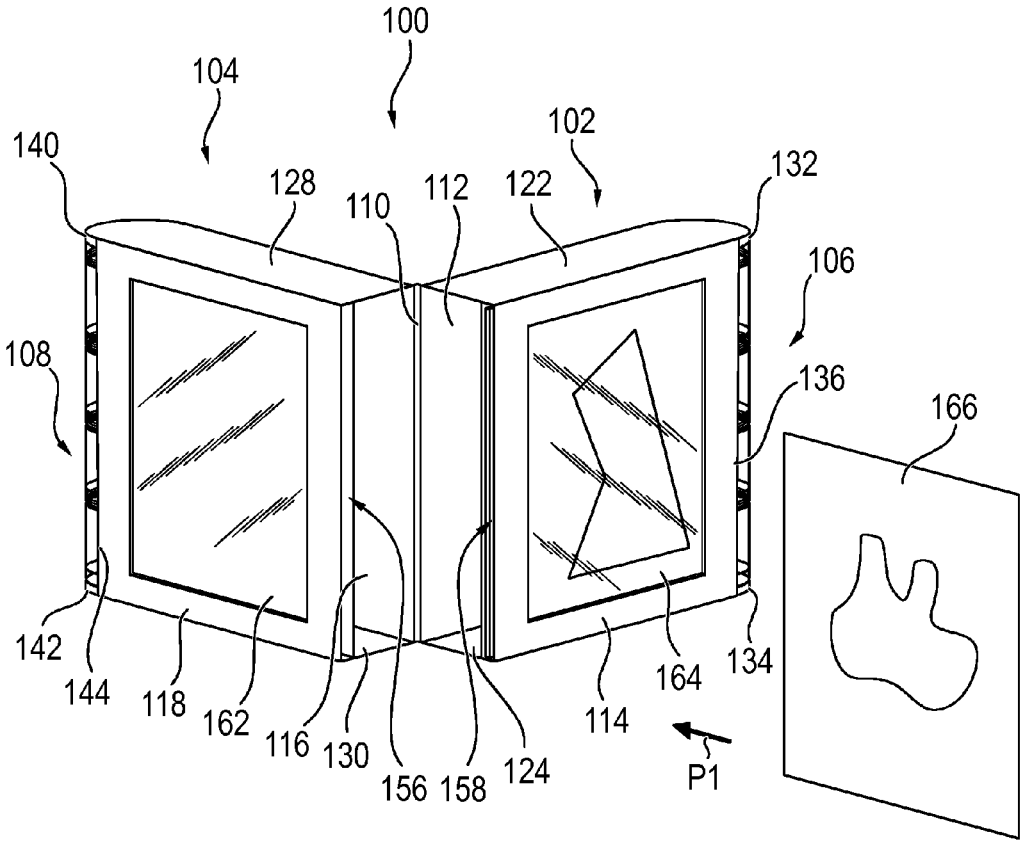
FIG. 10 is a further schematic perspective view of the device according to FIGS. 6 to 9.

FIG. 10 is a further schematic perspective view of the device 100 according to FIGS. 6 to 9. The picture 166 is introduced into the slide-in compartment 156 by being slided into the slide-in compartment 156 in the direction of arrow P1 via the opening of the slide-in compartment.

Figure 11:
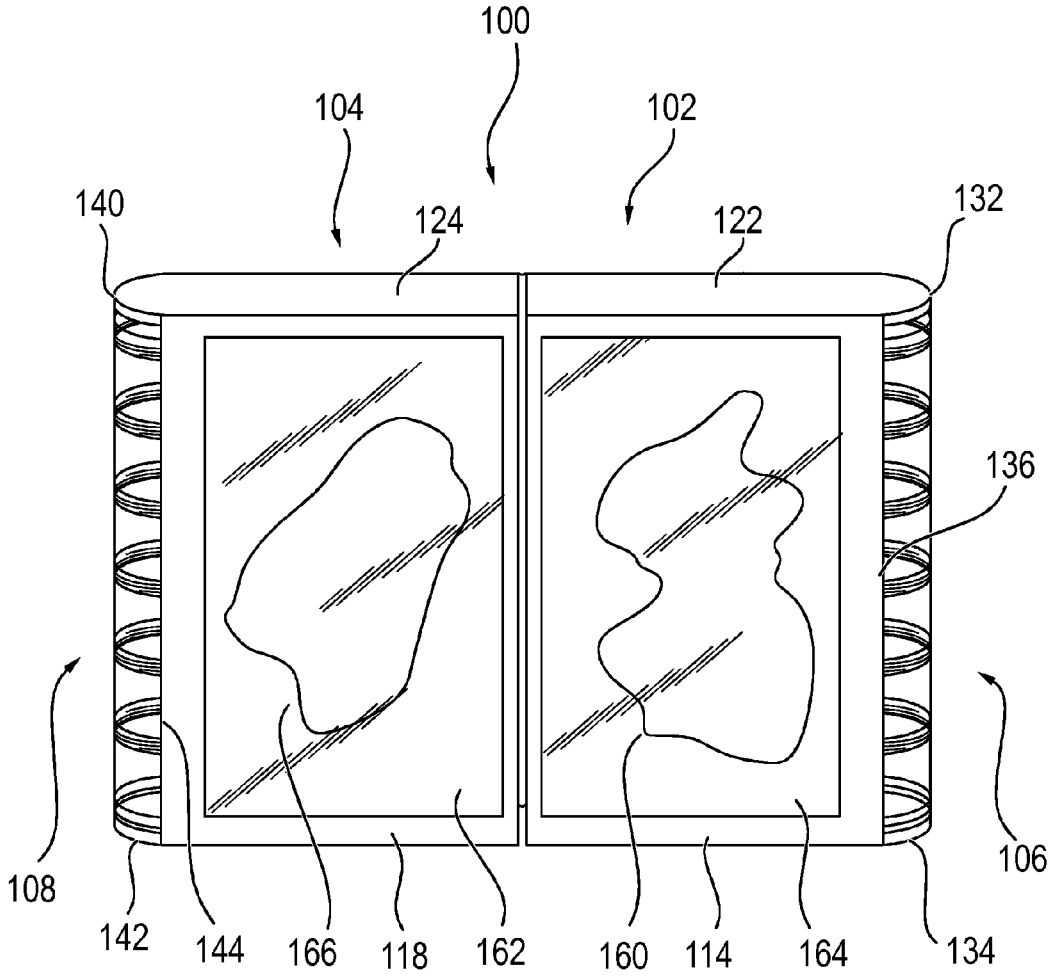
FIG. 11 is a further schematic perspective view of the device according to FIGS. 6 to 10 in a folded-apart condition with view onto the front side.

FIG. 11 is a further schematic perspective view of the device 100 according to FIGS. 1 to 10 in a folded-apart condition with view onto the second side walls 114, 118. In the folded-apart condition, the device 100 forms a picture frame for the pictures 160, 166 contained in the slide-in compartments 156, 158. When the device 100 is attached to a wall or positioned on a surface, the pictures 160, 166 can be viewed by a beholder just as if they were displayed in a picture frame. In addition to the storage units 106, 108, the slide-in compartments 156, 158 and the pictures 160, 166 contained in the slide-in compartments 156, 158, respectively produce a further possible way of individually shaping the device 100. The pictures 160, 166 contained in the slide-in compartments 156, 158 in particular topically relate to the book-like objects contained in the receiving regions of the slipcases 102, 104 and/or to the collectibles 116 contained in the storage units 106, 108.

The base units 12, 102, 104 may for example be made of paper, cardboard, metal, glass, plexiglass and/or leather. In addition or alternatively to the clipped connection, the storage units 14, 66, 106, 108 may also be connected to the base unit 12, 102, 104 by means of a magnetic connection. To this end, at least one receiving element 34 to 40, 132 to 146 of the base unit 12, 102, 104 comprises a magnet. In this case the storage units 14, 66, 106, 108 comprise a magnetic material, so that the storage unit 14, 66, 106, 108 is fixedly connectable to the base unit 12, 102, 104 via the magnet.

The invention claimed is:

1. A device for storing collectibles, comprising:

a storage unit (14, 66, 76 to 82) for collectibles (16); and a base unit (12) having a first receiving region (28) for receiving a first object and a second receiving region (42) for receiving the storage unit (14, 66, 76 to 82), wherein the base unit (12) comprises a first side wall (18), a second side wall (30), a connecting wall (24) connecting the side walls (18, 30) to each other, a first receiving element (34) fixedly connected to the connecting wall (24) and/or to one of the side walls (18, 30) and a second receiving element (36) fixedly connected to the connecting wall (24) and/or to one of the side walls (18, 30), the first receiving region (28) is delimited by the first side wall (18), the second side wall (30) and the connecting wall (24); the second receiving region (42), open on at least one side and separated from the first receiving region (28) by the connecting wall (24), is delimited by the first receiving element (34), the second receiving element (36) and the connecting wall (24); and wherein the storage unit (14, 66, 76 to 82) is attachable to the base unit (12) by means of the first receiving element (34) and/or the second receiving element (36), characterized in that the storage unit (14, 66, 76 to 82) comprises at least two segments (44 to 52, 68, 70) connectable to and separable from each other, each segment (44 to 52, 68, 70) has a receiving region for receiving at least one collectible (16), and in that at least a side wall of each segment (44 to 52, 68, 70) is transparent, each of the segments (44 to 52) comprising a bottom (58) and a cylindric wall (60) fixedly connected to the bottom (58), the receiving region of each of the segments (44 to 52) being delimited by the respective bottom (58) and the respective wall (60), and an opening (62) of a first segment (44 to 52), through which collectibles (16) can be introduced into the receiving region of the first segment (44 to 52), being locked by the bottom (58) of a second segment (44 to 52) when the first segment (44 to 52) and the second segment (44 to 52) are connected to each other.

2. The device (10) according to claim 1, characterized in that the segments (44 to 52, 68, 70) of the storage unit (14, 66, 76 to 82) are connectible to each other by means of a threaded connection (56), a latching connection, a clipped connection and/or a magnetic connection.

3. The device (10) according to any of the foregoing claims, characterized in that the entire storage unit (14, 66, 76 to 82) is transparent.

4. The device (10) according to claim 1, characterized in that the segments (44 to 52, 68, 70) are made of plexiglass.

5. The device (10) according to claim 1, characterized in that the storage unit (14, 66, 76 to 82) is attachable to the base unit (12) by a clipped connection constituted by the first receiving element (34) and the second receiving element (36).

* * * * *